US009399346B2

(12) United States Patent
Ohnishi

(10) Patent No.: US 9,399,346 B2
(45) Date of Patent: Jul. 26, 2016

(54) PRINTER HEAD CLEANING DEVICE AND INKJET PRINTING DEVICE

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/646,386

(22) PCT Filed: Nov. 22, 2013

(86) PCT No.: PCT/JP2013/081555

§ 371 (c)(1),
(2) Date: May 21, 2015

(87) PCT Pub. No.: WO2014/081019

PCT Pub. Date: May 30, 2014

(65) Prior Publication Data

US 2015/0336388 A1 Nov. 26, 2015

(30) Foreign Application Priority Data

Nov. 22, 2012 (JP) ..... 2012-256897

(51) Int. Cl.
*B41J 2/165* (2006.01)
*B08B 3/10* (2006.01)

(52) U.S. Cl.
CPC ..... *B41J 2/16552* (2013.01); *B08B 3/102* (2013.01); *B41J 2002/16567* (2013.01)

(58) Field of Classification Search
CPC . B08B 3/102; B41J 2/165; B41J 2002/16558; B41J 2/16552; B41J 2002/16567
USPC ..... 347/2, 4–6, 9, 12–14, 16, 17, 19–25, 347/27, 28, 30, 35, 40–44, 47, 68–72, 347/84–86, 96–98, 104, 105, 110, 197, 198
See application file for complete search history.

(56) References Cited

FOREIGN PATENT DOCUMENTS

| | | |
|---|---|---|
| JP | 2004-034702 | 2/2004 |
| JP | 2007-090584 | 4/2007 |
| JP | 2008-073638 | 4/2008 |
| JP | 2012-040502 | 3/2012 |

OTHER PUBLICATIONS

"International Search Report (Form PCT/ISA/210)", mailed on Dec. 17, 2013, with English translation thereof, pp. 1-3, in which three of the listed references (JP2012-040502A, JP2008-073638A, and JP2004-034702A) were cited.

*Primary Examiner* — Kristal Feggins
(74) *Attorney, Agent, or Firm* — Jianq Chyun IP Office

(57) ABSTRACT

The object is to reliably remove dirt and/or stains on the nozzle surface of a printer head. To accomplish the object, an inkjet printing device (100) is provided with a rotating brush (50) in a cap (103) mounted on a printer head (1), and a piezoelectric element (150) disposed on the side wall of the cap (103). The piezoelectric element (150) is ultrasonically vibrated at a predetermined frequency by means of a controller (20) and a power source (9). The ultrasonic vibration is transmitted into a cleaning solution in the cap (103) to remove dirt and/or stains adhered to a nozzle surface (3*a*). The rotating brush (50) is rotated by a motor, and its bristles (53) are vibrated by the ultrasonic vibration. Accordingly, dirt and/or stains on the nozzle surface (3*a*) are mechanically removed.

12 Claims, 11 Drawing Sheets

PRINTER HEAD CLEANING DEVICE AND INKJET PRINTING DEVICE

CROSS-REFERENCE TO RELATED APPLICATION

This application is a 371 application of an international PCT application serial no. PCT/JP2013/081555, filed on Nov. 22, 2013, which claims the priority benefit of Japan application no. 2012-256897, filed on Nov. 22, 2012. The entirety of each of the above-mentioned patent applications is hereby incorporated by reference herein and made a part of this specification.

TECHNICAL FIELD

The invention relates to a printer head cleaning device for use in cleaning a nozzle surface of the printer head, and an inkjet printing device.

BACKGROUND ART

FIG. 11 is a drawing of an example of a conventional inkjet head cleaning device. The illustrated inkjet head cleaning device 500 is provided with an ultrasonic cleaner 502 disposed in a lower section of a head cleaning container 501 which contains therein a cleaning solution 503. The frequency of the ultrasonic cleaner 502 can be changed by a frequency converter (not illustrated in the drawing). In the inkjet head cleaning device 500, an inkjet head 60 is immersed in the cleaning solution 503 contained in the head cleaning container 501 and cleaned with the vibration frequency being changed by the ultrasonic cleaner 502.

PRIOR ART DOCUMENT

Patent Document

Patent Document 1: JP 2007-90584 A.

SUMMARY OF THE INVENTION

Problems to be Solved by the Invention

The conventional inkjet head cleaning device 500 that solely relies on ultrasonic means to decontaminate the inkjet head, however, had the problem that dirt and/or stains that cannot be ultrasonically removed is often left on the nozzle surface. The tainted nozzle surface may cause clogging of the nozzle and/or deflection of ejected ink droplets. The invention was accomplished to solve these problems.

Solutions to the Problems

A printer head cleaning device according to the invention includes: a cleaning tank for containing therein a cleaning solution in which a nozzle surface of a printer head is to be immersed; and a cleaning vibration transmitting unit for applying an ultrasonic vibration at a frequency for cleaning to a brush to decompose contaminants in the cleaning solution, the brush being disposed in the cleaning tank and having a plurality of minute ends to make contact with the nozzle surface of the printer head.

With the nozzle surface of the printer head being immersed in the cleaning solution contained in the cleaning tank, the minute ends of the brush (for example, bristle ends of the brush) are brought into contact with the nozzle surface. Then, the ultrasonic vibration is transmitted to the nozzle surface from the cleaning vibration transmitting unit, for example, a piezoelectric element. The ultrasonic vibration decomposes and removes dirt and/or stains on the nozzle surface. At the same time, the minute ends of the brush in contact with the nozzle surface are vibrated to remove persistent dirt and/or stains still left thereon. By moving the brush, the minute ends scrape the nozzle surface, thereby removing dirt and/or stains on the nozzle surface. This advantageously removes dirt and/or stains that may be hardly ultrasonically cleaned out. Example of the cleaning vibration transmitting unit is piezoelectric elements or motors.

The brush may have a basal portion for holding the plurality of minute ends, and the cleaning vibration transmitting unit is disposed at the basal portion.

Disposing the cleaning vibration transmitting unit at the basal portion (for example, rotating shaft) allows ultrasonic to be directly applied to the basal portion, transmitting the vibration well to the minute ends of the brush. This effectively removes dirt and/or stains on the nozzle surface.

Furthermore, the printer head cleaning device may include a drive unit configured to move the whole brush and function as the cleaning vibration transmitting unit.

Moreover, moving the whole brush allows for more effective removal of dirt and/or stains on the nozzle surface. The drive unit that serves the role of the cleaning vibration transmitting unit makes it unnecessary to separately provide the cleaning vibration transmitting unit, simplifying the overall structure of the printer head cleaning device.

An inkjet printing device according to the invention includes: the printer head cleaning device; and a voltage applying unit for applying a voltage at a predetermined frequency to a vibration transmitting unit that transmits a vibration to a vibration member facing an ink chamber communicating with a nozzle of a printer head, wherein the voltage applying unit, during a normal mode, applies a voltage to the vibration transmitting unit to make an ink be discharged through the nozzle to carry out printing, and the voltage applying unit, during a cleaning mode, applies a voltage at a frequency different from a printing frequency to the vibration transmitting unit, the frequency being configured for cleaning the ink chamber and the nozzle.

The cleaning frequency is a frequency effective for dirt and/or stains in the printer head to fall off. Applying the voltage at such a frequency to the vibration transmitting unit transmits a vibration at the frequency into the printer head, removing dirt and/or stains in the printer head. The voltage at the cleaning frequency may be applied over a longer period of time than a period of time when the voltage is applied to carry out printing. By thus applying the voltage long enough, dirt and/or stains can be decomposed and cleaned off the wall surface of the ink chamber. Because the vibration transmitting unit provided for printing purpose is employed to generate the ultrasonic vibration for removal of dirt and/or stains in the printer head, an additional vibration transmitting unit becomes unnecessary.

Effects of the Invention

According to the invention, the brush can remove dirt and/or stains on the nozzle surface that may be hardly ultrasonically cleaned out.

EMBODIMENTS OF THE INVENTION

First Embodiment

Figure 1:
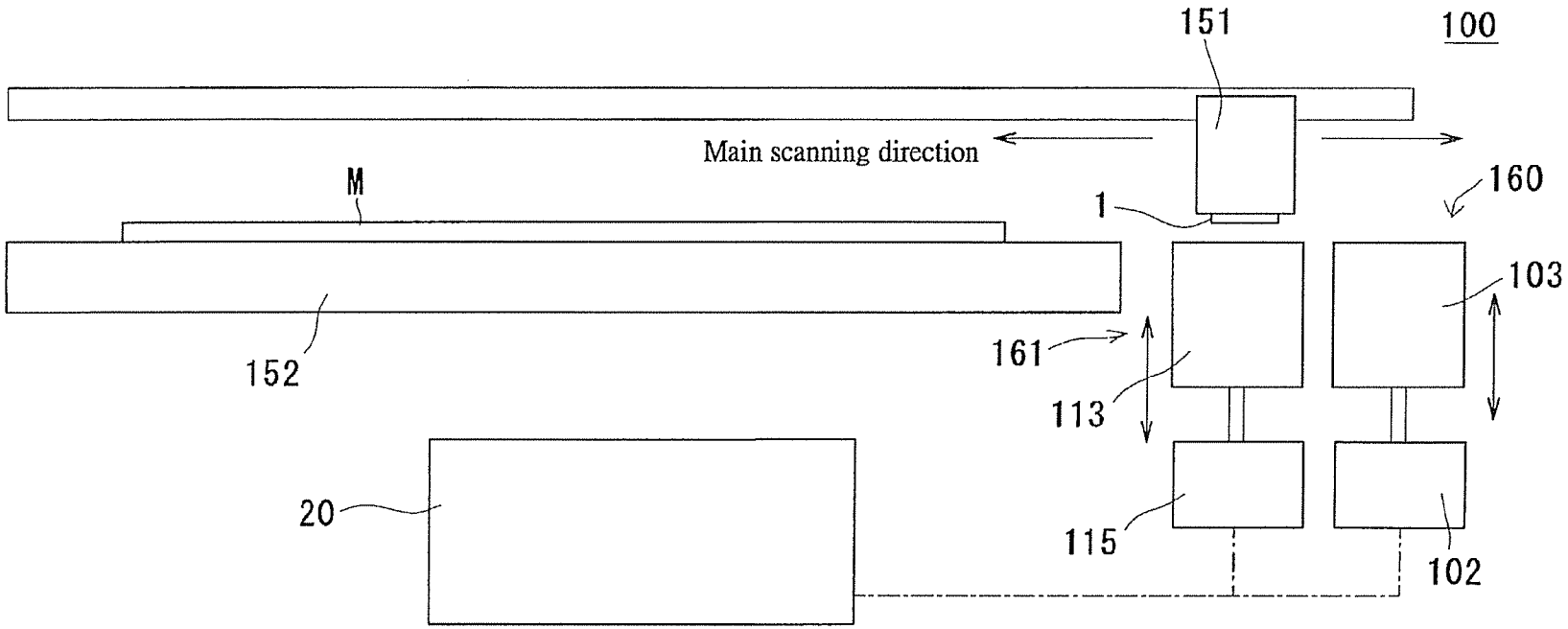
FIG. 1 is a drawing of an inkjet printing device according to a first embodiment of the invention.
Figure 5:
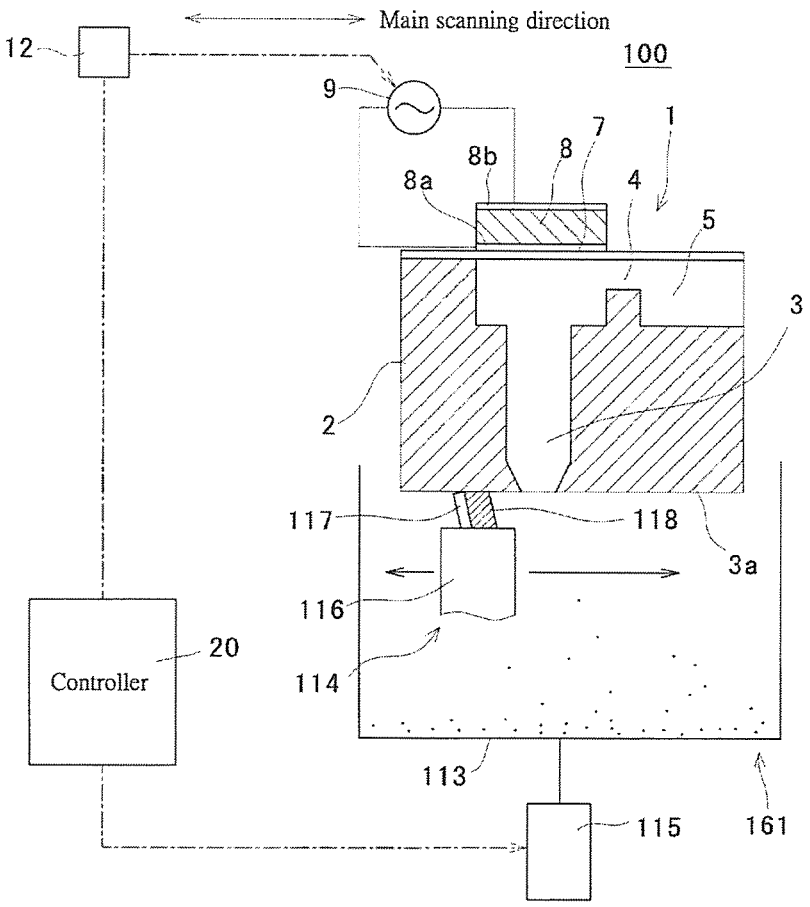
FIG. 5 is a drawing of a wiper unit of the inkjet printing device illustrated in FIG. 1.
Figure 6:
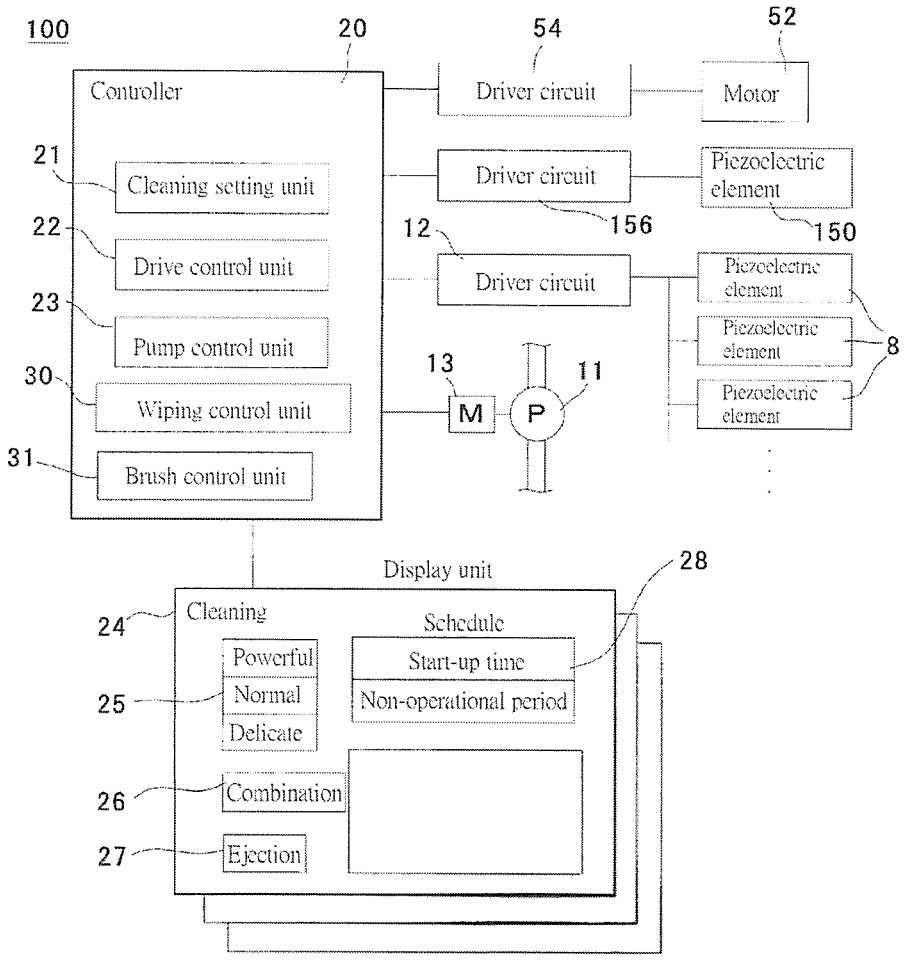
FIG. 6 is a drawing of a controller of the inkjet printing device.
Figure 7:
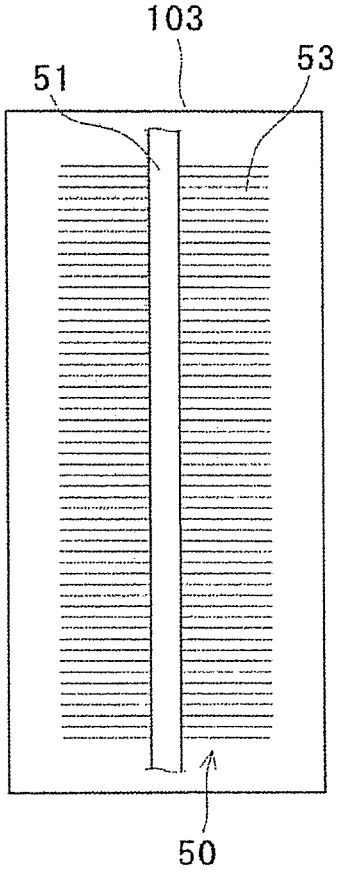
FIG. 7 is a plan view of a cap.

FIG. 1 is a drawing of an inkjet printing device according to a first embodiment of the invention. FIGS. 2A, 2B, 3, and 4 are drawings of a capping station of the inkjet printing device illustrated in FIG. 1. FIG. 5 is a drawing of a wiper unit of the inkjet printing device illustrated in FIG. 1. FIG. 6 is a drawing of a controller of the inkjet printing device. FIG. 7 is a plan view of a cap of the capping station. An inkjet printing device 100 includes a printer head 1, a carriage 151 that holds the printer head 1 and moves in a main scanning direction, a platen or table 152 on which a medium M is placed, a capping station 160 disposed outside a printing region of the medium M in the main scanning direction, a wiper unit 161 adjacent to the capping station 160, and a controller 20 for controlling an operation of the inkjet printing device.

Figure 4:
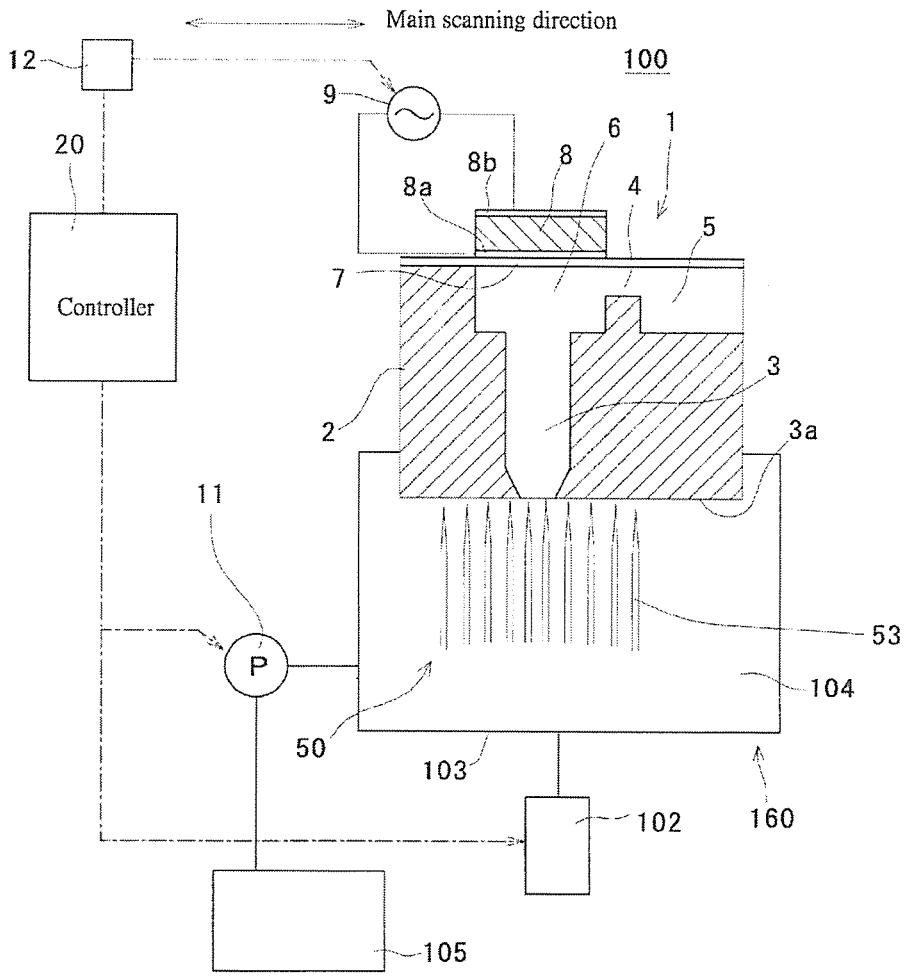
FIG. 4 is a drawing of the capping station of the inkjet printing device illustrated in FIG. 1.

As illustrated in FIG. 4, the printer head 1 has a body 2, a nozzle 3 with a discharge port on a nozzle surface 3*a* thereof, an inlet 5 connected to the nozzle 3 via a groove 4, an ink chamber 6 formed in an upper section of the nozzle 3, and a piezoelectric element 8 disposed in a layered form on a diaphragm membrane 7 facing the ink chamber 6 in an upper section thereof. The piezoelectric element 8 includes a lower electrode 8*a* and an upper electrode 8*b* stacked on each other. The lower electrode 8*a* and the upper electrode 8*b* are connected to a power source 9 that feeds power to the piezoelectric element 8. While FIG. 4 schematically illustrates an enlarged view of one nozzle 3, there are a large number of nozzles 3 on the nozzle surface 3*a* of the printer head 1. The power source 9 is connected to a driver circuit 12 that feeds a drive voltage to the piezoelectric element 8. The driver circuit 12 is controlled by the controller 20.

Figure 2A:
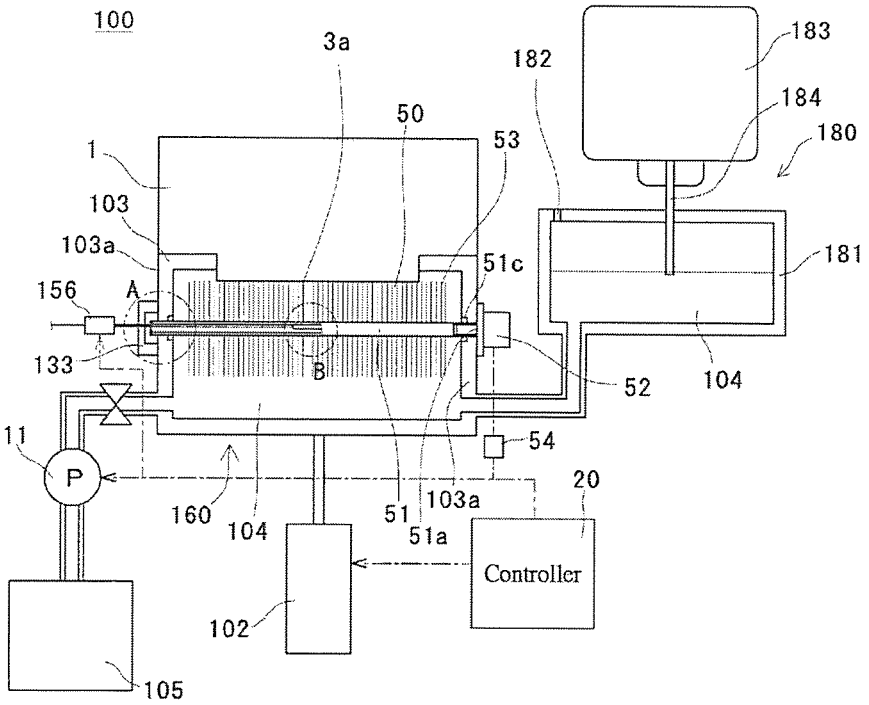
FIGS. 2A and 2B are drawings of a capping station of the inkjet printing device illustrated in FIG. 1.
Figure 2B:
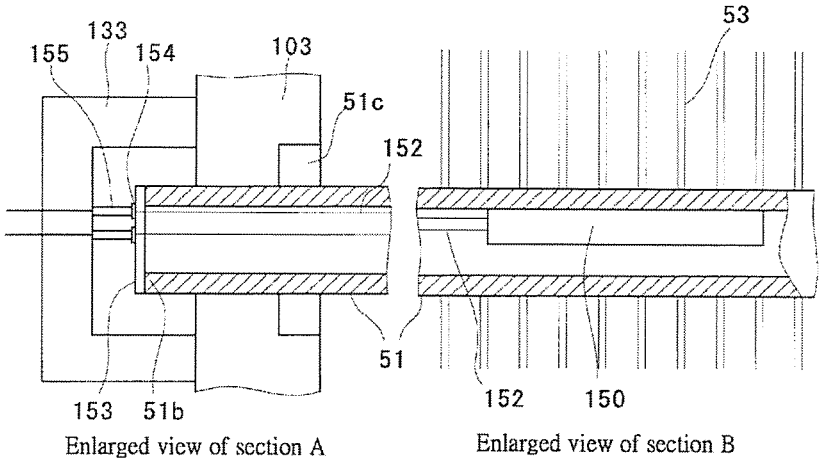

As illustrated in FIGS. 2A, 2B, and 4, the capping station 160 includes a cap 103 constituting a cleaning tank for pooling a cleaning solution 104, and an actuator 102 connected to the controller 20 to move the cap 103 upward and downward. A pump 11, including, for example, a tubing pump, is connected to the cap 103. The pump 11 is connected through a tube to a cleaning solution tank 105 containing the cleaning solution 104. The cap 103 is generally mounted on the printer head 1 to prevent the printer head 1 from drying.

Figure 3:
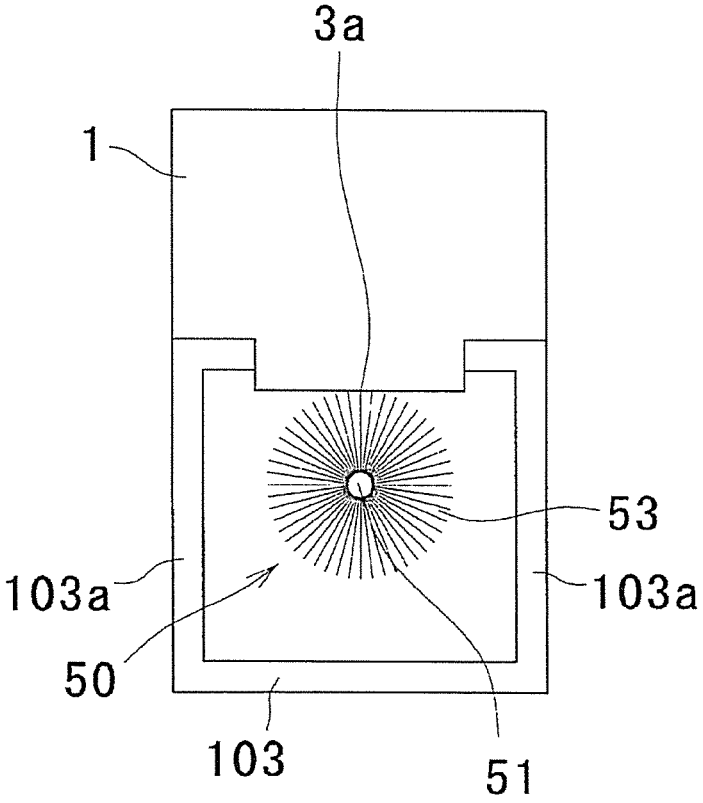
FIG. 3 is a drawing of the capping station of the inkjet printing device illustrated in FIG. 1.

As illustrated in FIGS. 2A, 2B, and 3, the capping station 160 has a rotating brush 50 in the cap 103. The rotating brush 50 has a hollow rotating shaft 51 pivotally supported by side walls 103*a* of the cap 103. One end 51*a* of the rotating shaft is connected to a motor 52. The rotating brush 50 has a large number of bristles 53 in the circumferential direction of the rotating shaft 51 which is a basal portion. The rotating brush 50 has an overall columnar shape. The bristles 53 have sharpened bristle ends. The bristles 53 of the rotating brush 50 are made from, for example, polypropylene, polyethylene terephthalate, polyester, nylon, or aramid. The rotating brush 50 is positioned such that the bristle ends of the brush 50 are in contact with the nozzle surface 3*a* of the nozzle 3 with the cap 103 being mounted on the printer head 1.

One end 51*a* of the rotating shaft 51 is allowed for engaging key grooves with the rotating shaft of the motor 52. The bristles 53 of the rotating brush 50 become the minute ends, therefore, when moving in contact with the nozzle surface 3*a*, dirt and/or stains on the nozzle surface 3*a* can easily be removed. The rotating shaft 51 is rotatably supported by the bearings of the cap 103. The motor 52 is connected to the controller 20. The motor 52 includes a stepping motor. The motor 52 is driven by a driver circuit 54. The driver circuit 54 controls rotations in response to drive signals outputted from a brush drive unit 31.

FIG. 2B provides enlarged views of sections A and B of the device encircled by dotted lines in FIG. 2A. As illustrated in FIG. 2B, a piezoelectric element 150 is disposed at substantially a central position on an inner side of the rotating shaft 51. An electric wire 152 for electric conduction is connected to the piezoelectric element 150. The electric wire 152 penetrates through the rotating shaft 51 and extends to the other end 51*b* of the rotating shaft 51. A disc-shaped lid 153 is attached to the other end 51*b* of the rotating shaft 51. A ring-shaped electrode 154 is formed on an outer surface of the lid 153. A cover 133 is attached to the other end 51*b*. A brush 155 is disposed inside the cover 133, and ends of the brush 155 make contact with the electrode 154. The brush 155 is connected to a driver circuit 156. The driver circuit 156 that drives the piezoelectric element 150 is connected to the controller 20.

An automatic level adjuster 180 is connected to the cap 103. The automatic level adjuster 180 includes an adjustment tank 181 connected to the cap 103 and containing therein the cleaning solution 104, and a supply tank 183 located above the adjustment tank 181. A tube 184 is extending downward from the bottom of the supply tank 183. One end of the tube 184 is immersed in the cleaning solution below its liquid level in the adjustment tank 181. The adjustment tank 181 has a communicating port 182 communicating with atmosphere.

The automatic level adjuster 180 maintains a certain liquid level in the cap 103 by supplying the cleaning solution 104 into the cap 103. In the automatic level adjuster 180, when the liquid level in the adjustment tank 181 lowers as a result of the cleaning solution 104 supplied out of the tank, the lower end of the tube 184 of the supply tank 183 emerges above the liquid level, and air comes in through the end of the tube 184. The air enters through the tube 184 into the supply tank 183, increasing the pressure in the supply tank 183. This lowers the liquid level in the supply tank 183, allowing the cleaning solution to flow through the tube 184 into the adjustment tank 181. The liquid level in the adjustment tank 181 is thereby elevated, and the lower end of the tube 184 accordingly sinks below the liquid level. This blocks the airflow through the tube end, interrupting the supply of the cleaning solution 104 from the supply tank 183. By repeating these steps, the liquid level in the adjustment tank 181 is constantly kept at a level near the end of the tube 184.

The wiper unit 161 has a container body 113, a wiper device 114 directed toward inside of the container body 113, and an actuator 115 that moves the container body 113 upward and downward. The wiper device 114 has a slider 116 that moves along the nozzle surface 3*a*, a long band-shaped wiper 117 made from a rubber and disposed in an upper section of the slider 116, and a sponge layer 118 formed in layers on the wiper 117. The slider 116 is moved by an actuator not illustrated in the drawings. The inside of the container body 113 has a structure where dirt and/or stains, including thickened ink, wiped off the nozzle surface 3*a* is dropped and accumulated.

The controller 20 has a cleaning setting unit 21 for setting the voltage to be applied to the piezoelectric element 150 and its frequency during a cleaning mode, a drive control unit 22 for outputting instructions to drive the piezoelectric element 150 to the driver circuit 156 based on the frequency set for the cleaning mode, a pump control unit 23 for controlling the drive of the pump 11, a wiping control unit 30 for controlling the wiper unit 161, and a brush control unit 31 for controlling the rotation of the rotating brush 50. The controller 20 and its elements such as cleaning setting unit 21, drive control unit 22, pump control unit 23, and wiping control unit 30 include hardware such as computing devices and memories, and programs for effectuating their predetermined functions.

During the cleaning mode, the cleaning setting unit 21 sets the frequency of vibration to be generated by the piezoelectric element 150 in three stages. Specifically, the frequencies of the vibration to be generated by the piezoelectric element 150 are within ranges of ±20% of 28 kHz, 45 kHz, and 100 kHz. A user may select any one of these frequencies or any one of combinations of these frequencies via the cleaning setting unit 21. The frequency is resettable to, for example, 30 kHz or 120 kHz by pressing a cleaning button 25 displayed on a display unit 24 connected to the controller 20. The display unit 24 may be, for example, a liquid crystal touch panel. The cleaning button 25 has three indications, "powerful cleaning", "normal cleaning", and "delicate cleaning". The "powerful cleaning" is performed at the low frequency, 28 kHz, "normal cleaning" at 45 kHz, and "delicate cleaning" at 100 kHz. The cleaning button 25 may be a mechanical button.

Alternatively, the voltage to be applied may have frequencies in which the above frequencies are superimposed. In that case, the frequencies superimposed on the piezoelectric element 150 are set via the cleaning setting unit 21. The superposition of frequencies can be performed fragmentally. For example, the voltage at the frequency of 100 kHz for "delicate cleaning" may be applied, while, at the same time, the voltage at the frequency of 28 kHz for "powerful cleaning" may be applied fragmentally. The pump 11 is driven by the motor 13. By using the cleaning setting unit 21, cleaning timing and cleaning time can be set. For example, the cleaning may be regularly performed at a particular point of time every other day, or performed automatically every time when the inkjet printing device 100 is activated.

The frequency may be configured to change continuously by, for example, 1 kHz at an interval within the range from 1 kHz to 100 kHz. The frequency may be linearly changed or changed in a manner that follows a predetermined curve.

The different cleaning intensities may be optionally combined. Any desired combination can be set on a screen (not illustrated in the drawings) displayed when a combination button 26 is pressed. For example, the cleaning may start with "powerful cleaning", after a given length of time, then "normal cleaning" is performed, and then after a given length of time, "delicate cleaning" is performed. The "powerful cleaning" may be performed only once and followed by "normal cleaning" and "delicate cleaning" alternately performed. By inputting the order, time lengths, and so on of these cleaning options via the cleaning setting unit 21, any desired combination is stored in the controller 20, and the controller 20 accordingly drives the piezoelectric element 150.

The cleaning solution in the cap 103 is ejected therefrom by starting to drive the pump 11 via an ejection button 27.

Figure 8:
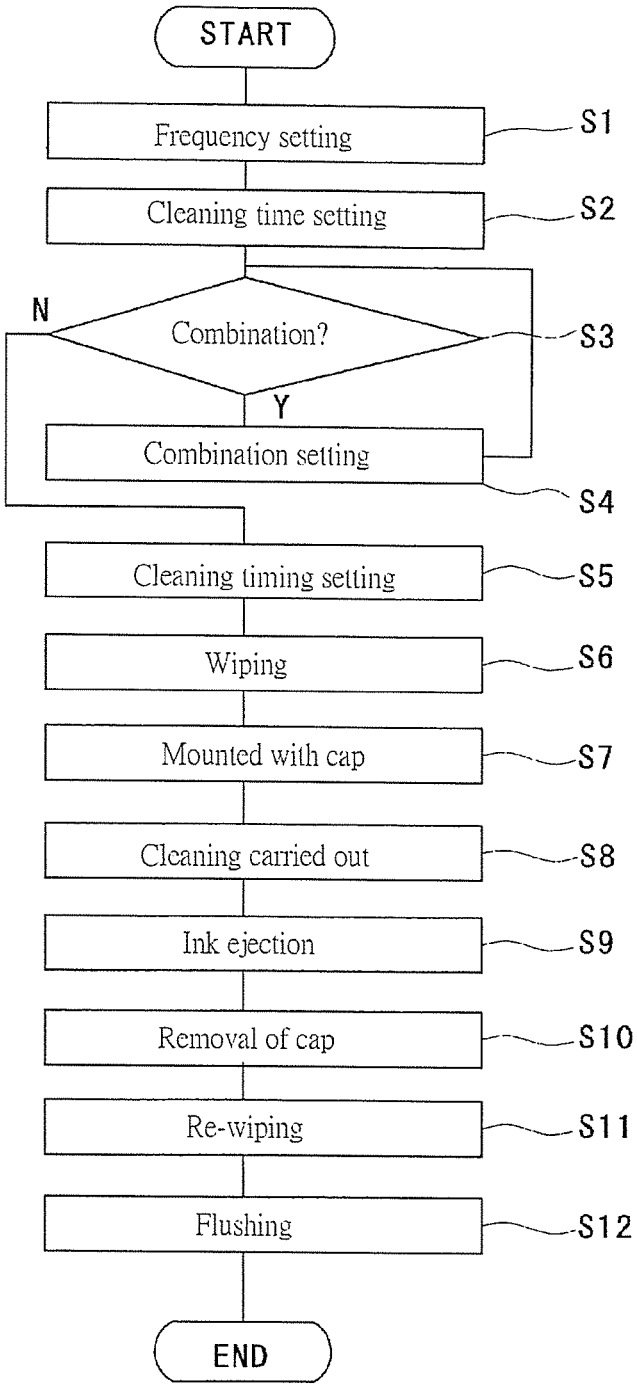
FIG. 8 is a flow chart of an operation of the inkjet printing device.

Hereinafter, the operation of the inkjet printing device 100 will be described. FIG. 8 is a flow chart of the operation of the inkjet printing device. The procedure described below is carried out by running a predetermined program.

Setting Cleaning Options

In the inkjet printing device 100, before starting to clean the printer head, a frequency configured for cleaning is set via the cleaning setting unit 21 (Step S1). For example, a user, whose choice is "powerful cleaning", presses the cleaning button 25 for "powerful cleaning" displayed on the display unit 24.

Subsequently, the user sets his/her desired cleaning time via the cleaning setting unit 21 (Step S2). The cleaning time is displayed on the display unit 24. The cleaning time can be set on the scale of seconds. If default values of the cleaning time for each of the cleaning levels are preset, users can skip the process of setting the cleaning time.

Next, the user, if he/she wants to combine the selected cleaning level ("powerful cleaning" in the above") with any other cleaning level at a different frequency (Step S3), presses the combination button 26 displayed on the display unit 24 (Step S4). Then, a combination screen (not illustrated in the drawings) is displayed, and for example, "delicate cleaning", may be selected via the cleaning button displayed on the combination screen. As a result of these steps, the "delicate cleaning" is performed subsequent to the "powerful cleaning". The cleaning levels may be selected and combined according to users' wishes. The cleaning button 25 and the ejection button 27 may be jointly used, which will be described later.

Next, the user sets his/her desired cleaning timing via the cleaning setting unit 21 (Step S5). The cleaning timing is, for example, a start-up time or a non-operational period of the inkjet printing device 100. These timing options are displayed on the display unit 24 by pressing a cleaning timing button 28. When the button is pressed for, for example, "non-operational period", the controller 20 displays a cleaning start time input screen (not illustrated in the drawings). The user inputs a point of time when he/she wants the cleaning to start during the non-operational period, for example, 0:00 am. When the button is pressed for "start-up time", the cleaning will automatically start the next time when the power source 9 is turned on.

Cleaning

To perform the cleaning, the carriage 151 is moved to a position above the wiper unit 161, and the actuator 115 is driven to attach the container body 113 of the wiper unit 161 to the printer head 1 (Step S6). Then, the slider 116 is moved to make the nozzle surface 3*a* be wiped off by the wiper 117 at the top of the slider 116. Accordingly, ink and/or dirt adhered to the nozzle surface 3*a* is wiped off by the wiper 117 and adsorbed to the sponge layer 118.

Next, the pump 11 is driven by the pump control unit 23 to transfer the cleaning solution 104 into the cap 103 of the capping station 160. Then, the printer head 1 is moved to a position above the cap 103, and the cap 103 is elevated by the actuator 102 and mounted on the nozzle surface 3*a* of the printer head 1 (Step S7).

The nozzle surface 3*a* of the printer head 1 covered with the cap is then immersed in the cleaning solution 104 in the cap 103 as illustrated in FIGS. 2A, 2B, and 4. Then, the piezoelectric element 150 is ultrasonically vibrated at the set frequency (Step S8). This ultrasonic vibration generates fine bubbles, and dirt and/or stains, including thickened ink, adhered to the nozzle surface 3*a* are removed by the actions of cavitation and accelerated energy. The ultrasonic wave also acts on the bristles 53 of the rotating brush 50, and vibrates them. The vibrated bristles 53 make contact with the nozzle surface 3*a* and mechanically remove dirt and/or stains adhered thereto.

Furthermore, the high-frequency vibration transmitted from the piezoelectric element 150 penetrates into the nozzle for decomposing dirt and/or stains on the inner wall of the nozzle 3, because the wavelength of the high-frequency vibration is shorter than the diametric dimension of the nozzle hole. Because the bristles 53 of the rotating brush 50 are located near the nozzle surface 3*a*, the ultrasonic vibration caused by the vibrating bristles 53 is also very likely to penetrate into the nozzle 3.

In addition to the ultrasonic vibration, the motor 52 is driven to rotate the rotating brush 50. When the rotating brush 50 is rotating, its sharpened bristle ends exert such an action that scrapes the nozzle surface 3*a*, for mechanically scraping dirt and/or stains off the nozzle surface 3*a*. The rotation rate of the rotating brush 50 is, for example, 0.5 rpm to 10 rpm. The dirt and/or stains thus decomposed and removed diffuse in the cleaning solution.

When the cleaning is over, the cleaning solution in the cap 103 is suctioned by the pump 11. The cleaning solution and the ink in the ink chamber 6 are then ejected through the nozzle 3 (Step S9). The cleaning solution containing the decomposed dirt and/or stains is ejected, and new ink is carried into the ink chamber 6.

After the ink is ejected, the actuator 102 is driven to move the cap 103 downward. Then, the cap 103 is removed from the printer head 1 (Step S10).

Next, the printer head 1 is moved again to a position above the wiper unit 161. Then, the actuator 115 is driven to push the wiper 117 against the nozzle surface 3*a* of the printer head 1, and the slider 116 is moved so that the nozzle surface 3*a* is wiped by the wiper 117 (Step S11).

Occasionally, inks of different colors are possibly pushed into the nozzle 3 during the wiping, in which case the piezoelectric element 8 is driven to flush the nozzle (Step S12) to eject such inks that accidentally penetrated into the nozzle 3. This flushing operation is performed with the printer head 1 being located inside the wiper unit 161. The flushed and ejected ink is dropped into the container body 113 of the wiper unit 161 and accumulated there. The cleaning of the printer head 1 in the cleaning mode is now completed, and the operation automatically returns to the normal printing mode.

According to the inkjet printing device 100 of the invention, by means of the ultrasonic vibration by the motor 52 and contact of the rotating brush 50, dirt and/or stains adhered to the nozzle surface 3*a* is certainly removed. The rotating brush 50 is not particularly limited as far as it has a large number of minute ends that make contact with the nozzle surface 3*a*. For example, the rotating shaft 51 with an unwoven fabric or fibers bundled in the form of a scrubbing brush may be used as the rotating brush 50 (not illustrated in the drawings).

Second Embodiment

During the cleaning mode, the piezoelectric element 8 installed in the printer head 1 for printing purpose, as well as the piezoelectric element 150 and the rotating brush 50, may be used to clean off dirt and/or stains. The power source 9 and the controller 20 constitute a voltage applying unit that applies a voltage at a frequency configured for cleaning to the piezoelectric element 8. The cleaning setting unit 21 applies a voltage at a predetermined cleaning frequency to the piezoelectric element 8. For example, the frequency of the voltage to be applied to the piezoelectric element 8 is 28 kHz for "powerful cleaning", 45 kHz for "normal cleaning", and 100 kHz for "delicate cleaning". These frequencies may be differently selected depending on the type of the ink and technical specification of the printer head 1. A user may select any one of voltages of these frequencies or any one of combinations thereof via the cleaning setting unit 21. The frequency is resettable by pressing the cleaning button 25 displayed on the display unit 24 connected to the controller 20.

The cleaning setting unit 21 controls the voltage to adjust the amplitude of the diaphragm membrane 7 by the piezoelectric element 8. During the normal mode for printing, the controller 20 applies a voltage having a frequency and amplitude required to discharge the ink through the nozzle 3 to the piezoelectric element 8.

By using the vibration of the piezoelectric element 8 during the cleaning, the cleaning solution 104 is gradually introduced into the ink chamber 6. All of the ink in the ink chamber 6 needs not be replaced with the cleaning solution. A predetermined ultrasonic vibration transmitted to the ink in the ink chamber 6 decomposes and cleans off dirt and/or stain adhered to the wall surface of the ink chamber 6. The cleaning solution 104 introduced into the ink chamber 6 captures therein the decomposed dirt and/or stains, preventing them from adhering to the wall surface again. The inside of the nozzle 3 is also cleaned by the described action of the cleaning solution 104.

When the cleaning solution in the cap 103 is suctioned by the pump 11 after cleaning, the ink in the ink chamber 6 is ejected through the nozzle 3. Thus, the ink containing the decomposed dirt and/or stains is directly ejected, and new ink is introduced into the ink chamber 6 by an ejection-induced pressure drop. The vibration during the cleaning mode causes cavitation in the ink, generating air bubbles. When the ink is ejected, such air bubbles in the ink are ejected as well. This prevents blank discharging that may be caused by air bubbles in the ink.

By thus using the piezoelectric element 8 in the diaphragm membrane 7 facing the ink chamber 6, the ink chamber 6 can be directly cleaned. Then, the ink chamber 6 is further cleaned with the cleaning solution 104. This ensures a remarkable cleaning effect.

In Step S9, the cleaning solution is suctioned from the cap 103 by the pump 11 after cleaning in order to decrease the internal pressure of the cap 103 to a negative pressure, thereby allowing for suctioning and ejection of the contaminated ink from the ink chamber 6 through the nozzle 3. Instead of suctioning the ink, the contaminated ink may be pushed out by feeding new ink into the ink chamber 6. Then, the cap 103 is moved downward and removed from the printer head 1 (Step S10). Then, the wiping step (Step S11) and the flushing step (Step S12) are similarly performed. These steps are set by the cleaning setting unit 21 of the controller 20, and the pump 11 and the wiper unit 161 are accordingly controlled to carry out these steps.

Figure 9A:
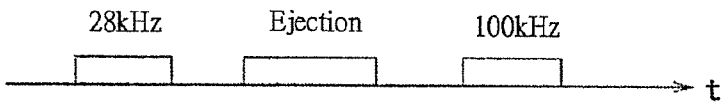
FIGS. 9A to 9D are drawings of an operation of an inkjet printing device according to a second embodiment of the invention.

Since fine air bubbles have the effect of attenuating high frequencies. If fine air bubble are generated, the cleaning setting unit 21 of the controller 20 optionally ejects the ink and then performs the cleaning at a different frequency. For example, as illustrated in FIG. 9A, the "powerful cleaning" is performed at the frequency of 28 kHz to eject the ink with fine air bubbles out of the ink chamber 6. Then, new ink is introduced into the ink chamber 6, and the "delicate cleaning" is performed thereto at the frequency of 100 kHz. By ejecting the ink with fine air bubbles and then performing cleaning at a different frequency, the cleaning effect is further improved. An even better cleaning effect can be achieved by ejecting the contaminated ink and introducing new ink prior to the high-frequency cleaning.

Figure 9B:
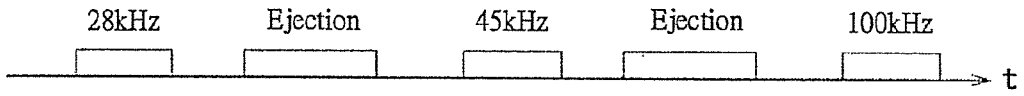

As illustrated in FIG. 9B, ejecting the ink may be performed between the "powerful cleaning", "normal cleaning", and "delicate cleaning". The ink is ejected through the cap 103 by driving the pump 11.

Figure 9C:
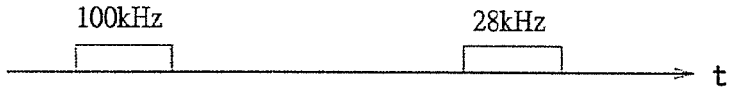
Figure 9D:
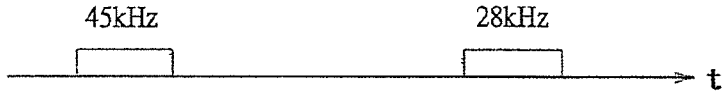

As illustrated in FIG. 9C, the high-frequency cleaning ("delicate cleaning" at 100 kHz) may be performed first, followed by the low-frequency cleaning unlikely to be affected by air bubbles (for example, "powerful cleaning" at 28 kHz lower than the frequencies of the other cleaning options). The cleaning options performed in this order allow the cleaning to be carried out without ejecting the ink, while preventing the frequency from being attenuated by fine air bubbles. Alternatively, the "normal cleaning" and the "powerful cleaning" may be performed in this order as illustrated in FIG. 9D.

Third Embodiment

Figure 10A:
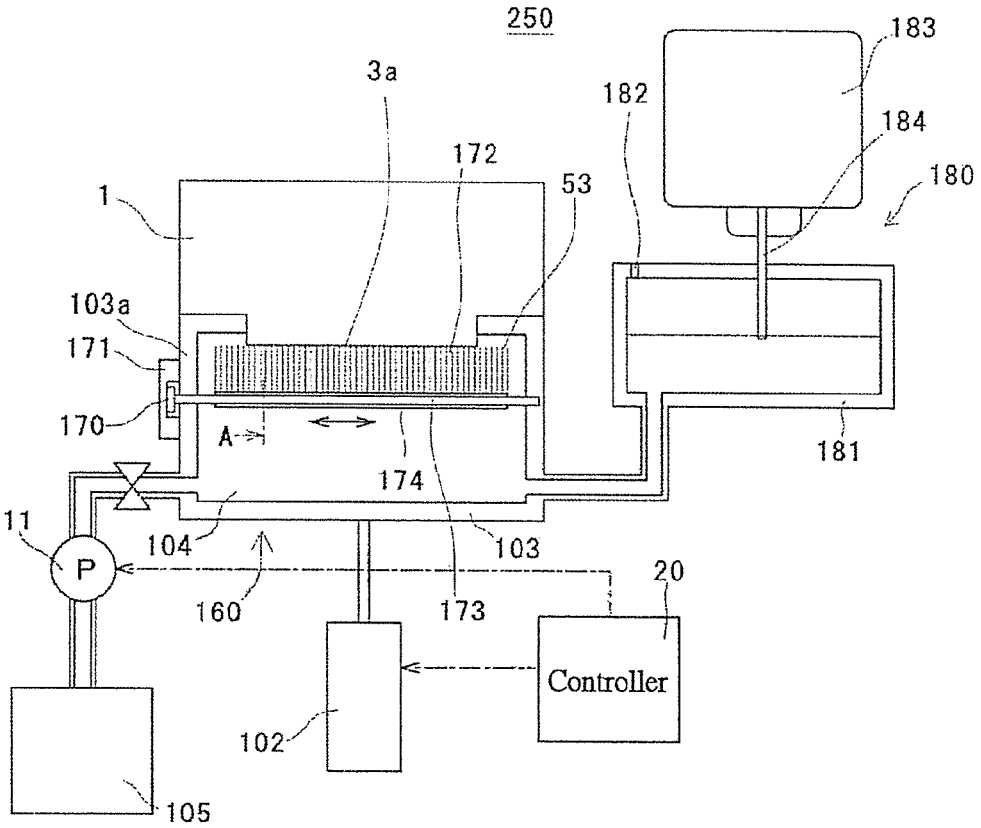
FIGS. 10A and 10B are drawing of an inkjet printing device according to a third embodiment of the invention.
Figure 10B:
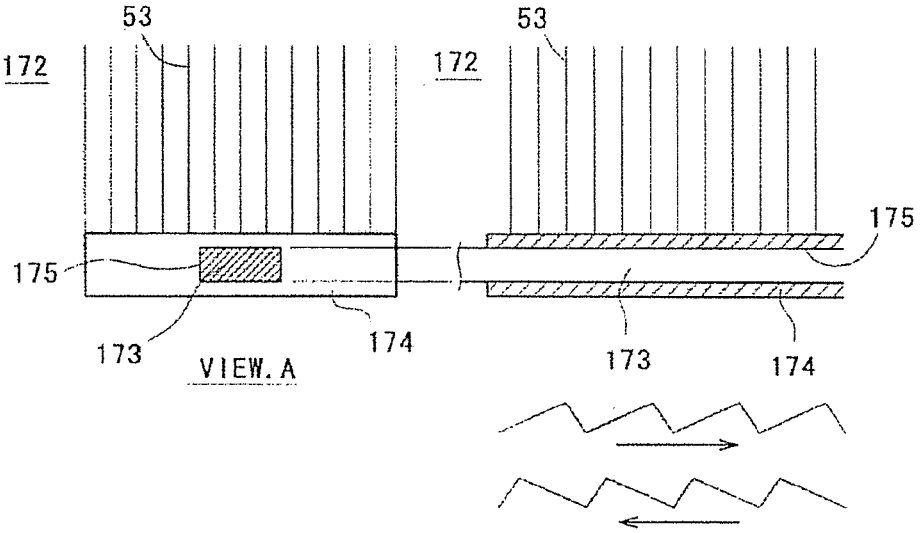
Figure 11:
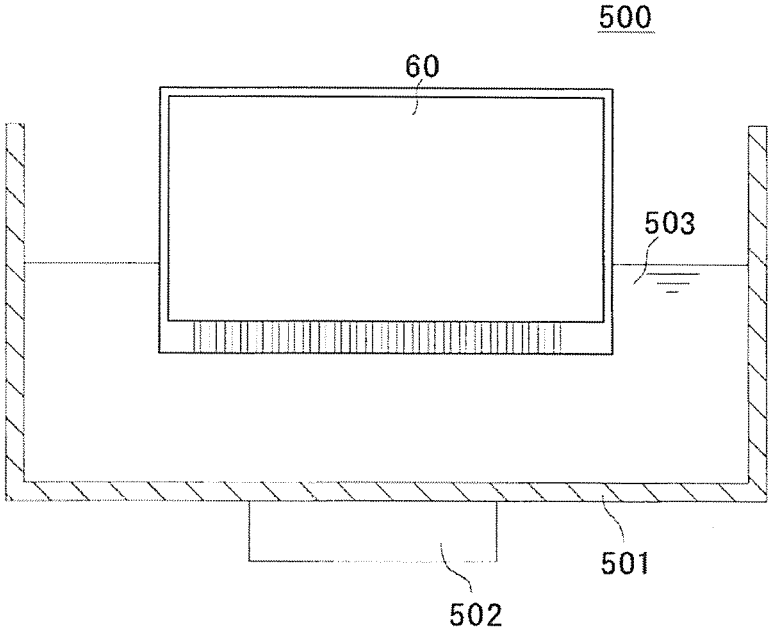
FIG. 11 (RELATED ART)
FIG. 11 is a drawing of an example of the conventional inkjet head cleaning devices.

FIGS. 10A and 10B are drawings of an inkjet printing device according to a third embodiment of the invention. An inkjet printing device 250 is constituted similarly to the inkjet printing device 100 according to the first embodiment, except that a piezoelectric element 170 is disposed at an end of a drive shaft 173 of a brush 172, and the drive shaft 173 is inserted through a cavity 175 of a base 174 of the brush 172. Any other configurations, which are the same as those of the first embodiment, will not be described again.

The piezoelectric element 170 is secured to the cap 103 by a cover 171. The drive shaft 173 made of a metal is jointed to the piezoelectric element 170. The drive shaft 173 has a rectangular shape in cross section, and is disposed in the cap 103 in its longitudinal direction. As illustrated in FIG. 10A, the cavity 175 of the base 174 has a rectangular shape in cross section that allows the drive shaft 173 to be inserted therethrough. The brush 172 is accordingly allowed to slidably move, while being restricted from rotating along the drive shaft 173. The piezoelectric element 171 provides a wave motion of a certain shape for the drive shaft 173, reciprocating the base 174 with the drive shaft 173 inserted therein.

The base 174 is reciprocated by the signal waveform of a voltage applied to the piezoelectric element 170 that makes the drive shaft 173 slowly elongate in one direction but quickly contract in the opposite direction. As illustrated in FIG. 10B, the base 174 is moved to right on the drawing by moderating the left side of an angular waveform representing telescopic displacements on the drawing, whereas the base 174 is moved to left on the drawing by moderating the right side of the angular waveform representing telescopic displacements on the drawing. These movements are controlled by the brush drive unit 31 of the controller 20. The frequency provided for the drive shaft 173 is the cleaning frequency described in the first embodiment so as to transmit the ultrasonic vibration into the cleaning solution and to vibrate bristle ends of the brush 172.

The brush 172 is reciprocated by the predetermined wave motion provided for the drive shaft 173. This reciprocating movement allows the bristle ends of the brush 172 to scrape the nozzle surface 3*a*, mechanically removing dirt and/or stains adhered to the nozzle surface 3*a*. Moreover, the ultrasonic vibration is transmitted from the brush 172 into the cleaning solution, and ultrasonic then penetrates into the nozzle 3, decomposing and removing dirt and/or stains in the nozzle 3. Thus, the ultrasonic wave transmitted from the cleaning solution and penetrating into the nozzle 3 decomposes and cleans off dirt and/or stains in the nozzle 3 and the ink chamber 6.

As described so far, a single structural arrangement can realize the drive unit that reciprocates the brush 172 and the cleaning vibration transmitting unit that applies the ultrasonic vibration to the cleaning solution. This advantage makes it unnecessary to provide the motor and the piezoelectric element separately, structurally simplifying the device.

Other Embodiment

Though not illustrated in the drawings, the motor 52 used in the first embodiment may be replaced with an ultrasonic motor. In the case, the piezoelectric element 150 becomes unnecessary. The high-frequency ultrasonic during the rotation may be mechanically retrieved from a stator coupled to the rotating shaft 51. For example, the piezoelectric element of the stator may be slidably coupled by a pressing force to an end part of the rotating shaft 51, and the rotating shaft of the ultrasonic motor and the rotating shaft 51 may be connected to each other with a decelerator interposed therebetween. The motor 52 may be a high-resolution step motor, and the device is controlled so as to cause a vibration in the step motor. In this case, the piezoelectric element 150 is unnecessary.

The invention claimed is:

1. A printer head cleaning device, comprising:

a cleaning tank, contains therein a cleaning solution in which a nozzle surface of a printer head is to be immersed; and a cleaning vibration transmitting unit, applies an ultrasonic vibration at a frequency for cleaning to a brush to decompose contaminants in the cleaning solution, and the brush being disposed in the cleaning tank and having a plurality of minute ends to make contact with the nozzle surface of the printer head, wherein the brush is rotated around a rotating shaft while the brush receives the ultrasonic vibration.

2. The printer head cleaning device according to claim 1, wherein the brush has a basal portion for holding the plurality of minute ends, wherein the cleaning vibration transmitting unit is disposed at the basal portion.

3. The printer head cleaning device according to claim 2, further comprising:

a drive unit, moves whole of the brush, and the drive unit functions as the cleaning vibration transmitting unit.

4. An inkjet printing device, comprising:

the printer head cleaning device according to claim 3; and a voltage applying unit, applies a voltage at a predetermined frequency to a vibration transmitting unit that transmits a vibration to a vibration member facing an ink chamber communicating with a nozzle of a printer head, wherein the voltage applying unit, during a normal mode, applies a voltage to the vibration transmitting unit to make an ink be discharged through the nozzle to carry out printing, and the voltage applying unit, during a cleaning mode, applies a voltage at a frequency different from a printing frequency to the vibration transmitting unit, the frequency being configured for cleaning the ink chamber and the nozzle.

5. The inkjet printing device according to claim 4, wherein in the nozzle, air bubbles are generated in the ink, and the ink with the air bubbles is ejected, and then a new ink is introduced.

6. An inkjet printing device, comprising:

the printer head cleaning device according to claim 2; and a voltage applying unit, applies a voltage at a predetermined frequency to a vibration transmitting unit that transmits a vibration to a vibration member facing an ink chamber communicating with a nozzle of a printer head, wherein the voltage applying unit, during a normal mode, applies a voltage to the vibration transmitting unit to make an ink be discharged through the nozzle to carry out printing, and the voltage applying unit, during a cleaning mode, applies a voltage at a frequency different from a printing frequency to the vibration transmitting unit, the frequency being configured for cleaning the ink chamber and the nozzle.

7. The inkjet printing device according to claim 6, wherein in the nozzle, air bubbles are generated in the ink, and the ink with the air bubbles is ejected, and then a new ink is introduced.

8. The printer head cleaning device according to claim 1, further comprising:

a drive unit, moves whole of the brush, and the drive unit functions as the cleaning vibration transmitting unit.

9. An inkjet printing device, comprising:

the printer head cleaning device according to claim 8; and a voltage applying unit, applies a voltage at a predetermined frequency to a vibration transmitting unit that transmits a vibration to a vibration member facing an ink chamber communicating with a nozzle of a printer head, wherein the voltage applying unit, during a normal mode, applies a voltage to the vibration transmitting unit to make an ink be discharged through the nozzle to carry out printing, and the voltage applying unit, during a cleaning mode, applies a voltage at a frequency different from a printing frequency to the vibration transmitting unit, the frequency being configured for cleaning the ink chamber and the nozzle.

10. The inkjet printing device according to claim 9, wherein in the nozzle, air bubbles are generated in the ink, and the ink with the air bubbles is ejected, and then a new ink is introduced.

11. An inkjet printing device, comprising:

the printer head cleaning device according to claim 1; and a voltage applying unit, applies a voltage at a predetermined frequency to a vibration transmitting unit that transmits a vibration to a vibration member facing an ink chamber communicating with a nozzle of a printer head, wherein the voltage applying unit, during a normal mode, applies a voltage to the vibration transmitting unit to make an ink be discharged through the nozzle to carry out printing, and the voltage applying unit, during a cleaning mode, applies a voltage at a frequency different from a printing frequency to the vibration transmitting unit, the frequency being configured for cleaning the ink chamber and the nozzle.

12. The inkjet printing device according to claim 11, wherein in the nozzle, air bubbles are generated in the ink, and the ink with the air bubbles is ejected, and then a new ink is introduced.

* * * * *